US006361094B1

(12) United States Patent
Pelley

(10) Patent No.: US 6,361,094 B1
(45) Date of Patent: Mar. 26, 2002

(54) OBJECT RETRIEVAL APPARATUS

(76) Inventor: James R Pelley, 87 Middleton Rd., Wolfeboro, NH (US) 03894

( * ) Notice: Subject to any disclaimer, the term of this patent is extended or adjusted under 35 U.S.C. 154(b) by 0 days.

(21) Appl. No.: 09/560,986

(22) Filed: Apr. 28, 2000

(51) Int. Cl.[7] ..... A63B 47/02

(52) U.S. Cl. ..... 294/19.2; 294/19.1; 294/66.1; 294/115

(58) Field of Search ..... 294/19.1, 19.2, 294/66.1, 66.2, 115

(56) References Cited

U.S. PATENT DOCUMENTS

| | | | | | |
|---|---|---|---|---|---|
| 1,220,481 | A | * | 3/1917 | Wedge | 294/115 |
| 2,336,527 | A | * | 12/1943 | Bullington | 294/115 |
| 3,446,525 | A | * | 5/1969 | Jones | 294/115 |
| 3,669,427 | A | * | 6/1972 | Curtis | 294/19.2 |
| 4,172,610 | A | * | 10/1979 | Johnson | 294/19.1 |
| 4,441,746 | A | * | 4/1984 | Corboy, Jr. | 294/115 |
| 4,466,650 | A | * | 8/1984 | Roedel | 294/19.2 |
| 5,335,953 | A | * | 8/1994 | Luther, Sr. | 294/19.2 |
| 5,669,646 | A | * | 9/1997 | Fiocca et al. | 294/19.2 |
| 6,045,288 | A | * | 4/2000 | Pastenak et al. | 294/19.2 |
| 6,059,334 | A | * | 5/2000 | LaCourse et al. | 294/19.2 |

FOREIGN PATENT DOCUMENTS

| | | | | |
|---|---|---|---|---|
| FR | 614299 | * | 9/1926 | 294/115 |
| GB | 204161 | * | 7/1922 | 294/115 |

* cited by examiner

*Primary Examiner*—Eileen D. Lillis
*Assistant Examiner*—Paul T. Chin
(74) *Attorney, Agent, or Firm*—Michael J. Persson; Lawson, Philpot & Persson, P.C.

(57) ABSTRACT

An object retrieval apparatus including a base plate having an opening disposed therethrough at a predetermined location. At least two jaws are pivotally attached to the base plate. An actuator is movably disposed through the opening in the base plate and is fixedly attached to a retention member. At least two pivot arms are pivotally attached to the retention member and the jaws. Finally, a closing means is provided for closing the jaws. In operation, the actuator is positioned such that the jaws are in open position. The actuator is then caused to contact the object to be retrieved, or a surface proximate to the object, such that the retention member and the pivot arms are moved towards the base plate, causing the jaws to pivot inward. Once the actuator is moved past a trigger point, the closing means is engaged and acts to drives the jaws inward. This inward movement causes the retention member and actuator to move toward the base plate such that a space is created between the actuator and the closed jaws for accommodating the object to be retrieved.

17 Claims, 8 Drawing Sheets

OBJECT RETRIEVAL APPARATUS

FIELD OF THE INVENTION

The invention relates to the field of object retrieval, and in particular, to an apparatus for retrieving objects that does not require direct user intervention.

BACKGROUND OF THE INVENTION

Retrieving objects that are out of reach is a problem that occurs with regularity for most people. For example, people will often utilize a chair to retrieve objects from a top shelf of a cupboard, or utilize a specialized retrieval apparatus to retrieve a golf ball from a water hazard, or fruit from a high branch of a tree.

One particular retrieval problem confronts hunters who utilize tree stands. A hunter will often ascend a tree stand and, while waiting for game to approach, will drop an object, such as a glove, arrow or the like, to the ground. When this happens, the hunter is left with the choice of leaving the object at the base of the tree, or descending from the tree stand and running the risk of scaring off the game and drawing the ire of other hunters in the area, or of leaving an unwanted scent that will, again, run the risk of scaring off the game. This problem confronted the inventor of the present invention while hunting and was the reason for the development of the object retrieval apparatus disclosed and claimed herein.

Tree stands are often located a significant distance off of the ground and, therefore, any retrieval apparatus must be operable from a distant location. Further, the remote locations of many tree stands, and the underbrush often encountered en route to the stand, necessitate that any retrieval apparatus be relatively lightweight and be readily stored in a hunter's pack. Finally, because many different types and sizes of objects may be dropped, any apparatus must be able to retrieve objects of various types and sizes.

A number of issued patents are directed to solving the problem of object retrieval. However, each have drawbacks that make them unsuitable for solving the present problem. One such patent is U.S. Pat. No. 4,441,746, issued to Corboy et al on Apr. 10, 1984. This patent discloses a manually operated hand held pick up tool having an elongated rigid tube with a movable jaw assembly at one end and a handle assembly at the other. The movable jaws of the jaw assembly are caused to approach each other in a symmetrical fashion and come into apposition when a sliding handle piece in the handle assembly is squeezed and brought toward a fixed handle.

The device described in this patent is effective at retrieving a variety of objects. However, the reach is limited by the length of the rigid tube. Accordingly, a tube of substantial length would be required in order to allow a hunter to retrieve an object from a tree stand. A device having such a tube would be impractical for a hunter to carry into the woods, due to its length and weight, and would be difficult to carry while climbing a tree.

Another retrieval apparatus is described in U.S. Pat. No. 5,649,729, issued to Peterson on Jul. 22, 1997. This patent discloses an object retrieval system that utilizes a single line grab in conjunction with a pair clam shell type jaws. The line grab is anchored at one end and is selectively extensible and retractable such that the halves of the jaws may be selectively opened or closed through extension and retraction of the line. This patent is effective at retrieving objects. However, this device must include a fixed housing to allow the line to be extended. Accordingly, if it were to be adapted for use by hunters, it would require a long rigid and substantially heavy tube, similar to the tube described in the Corby patent. In addition, the clam shell arrangement of the jaws is not adapted for the retrieval of objects, such as arrows, that may be dropped from a tree stand.

Another retrieval apparatus is described in U.S. Pat. No. 5,411,304, issued to Muto et al. on May 2, 1995. This patent discloses a grab bucket with grabbing claws provided for opening and closing around the main body suspended from a crane. Like the device of the Peterson patent, the Muto device must include a fixed housing to allow the line to be extended. Accordingly, if it were to be adapted for use by hunters, it would require a long rigid and substantially heavy tube. Thus, it is not suited to solving the problem solved by the present invention.

U.S. Pat. Nos. 4,765,087, 4,766,693, 4,807,389 disclose animal traps that employ tension members, jaws, and triggers. These elements combine to create a suitable trap. However, they do not capture objects without doing damage to the objects to be retrieved. Further, these devices must also be anchored and, therefore, would also require a long rigid and substantially heavy tube. As this is the case, none of the device described in these patents may be adapted to solve the problem that is solved by the present invention.

An object retrieval apparatus that is operable from a distant location, that is relatively lightweight, that may be readily stored in a hunter's pack, and is able to retrieve objects of various types and sizes, is not known in the art.

SUMMARY OF THE INVENTION

The present invention is a light weight object retrieval apparatus that requires no hand strength or dexterity to operate, that can reach objects that are a significant distance away from the operator, and is adapted to pick up a variety of objects.

In its most basic form, the object retrieval apparatus of the present invention includes a base plate having an opening disposed therethrough at a predetermined location. At least two jaws are pivotally attached to the base plate. An actuator is movably disposed through the opening in the base plate and is fixedly attached to a retention member. At least two pivot arms are pivotally attached to the retention member and the jaws. Finally, a closing means is provided for closing the jaws.

In operation, the actuator is positioned such that the jaws are in an open position. The actuator is then caused to contact the object to be retrieved, or a surface proximate the object, such that the retention member and the pivot arms are moved towards the base plate, which causes the jaws to pivot inward. Once the actuator is moved past a trigger point, the closing means is engaged and acts to drive the jaws inward. This inward movement causes the retention member and actuator to move toward the base plate such that a space is created between the actuator and the closed jaws for accommodating the object to be retrieved.

In the preferred embodiment, the apparatus has a triangular shaped base plate constructed of a light weight, rigid, and durable material, such as plastic or metal. The preferred base plate has an opening disposed through its center to slidably accept the actuator and details at each point of the triangular plate to accept mating details on the jaws.

The preferred actuator is a cylindrical rod, also constructed of a rigid material, which has a ring or other attachment means attached at one terminus to accept a rope or string and a point or tip at the opposite terminus. The length of the portion of the actuator that extends through the retention member is determined by the length and shape of the jaws and the desired travel of the retention member. In the preferred embodiment, the actuator is dimensioned to allow its tip to extend beyond the tips of the opened jaws when extended and to be disposed a sufficient distance from the tips of the jaws when retracted such that a space is created between the jaws and the tip of the actuator for allowing a variety of objects to be retrieved.

The preferred retention member is also triangular and has three pivot arms pivotally attached to the three points of the triangles. Each of the three pivot arms are pivotally attached to one of the three jaws at a location that allows the jaws to close when the retention member and the pivot arms move towards the base plate.

The preferred jaws are substantially "C" shaped and are constructed of a light weight material having cut-outs along its width. These cut-outs lessen the overall weight of the apparatus and reduce resistance to wind and water, which could make the alignment between the apparatus and the object more difficult. The preferred jaws come to a point at one terminus and include a hooked mating detail at the other terminus to pivotally attach each jaw to the base plate. Each of the preferred jaws also includes a slot that is dimensioned to accept a predetermined elastic band, which is the preferred closing means. Elastic bands are the preferred closing means because they are inexpensive, readily available, and allow different forces to be exerted upon the jaws. The position of the slots within the jaws is determined by the size of the pivot arms and the retention member. In this embodiment, the apparatus is self actuating, i.e. it requires little or no user intervention in order to close the jaws about the object.

In one alternative embodiment of the invention, the base plate is attached to a hollow tube having a handle disposed at an opposite end such that it may be used as a reacher for assisting the elderly or disabled. In these embodiments, it is preferred the actuator extend through the tube and terminate in a loading knob, or other protrusion, that extends from the handle end of the tube. In some of these embodiments, a wrist or forearm brace may be utilized in order to assist the user in stabilizing the reacher, eliminating the need for fine motor skills.

In another alternative embodiment, the apparatus is adapted for use as a golf ball retrieval apparatus or fruit picker. In these embodiments, the base plate of the apparatus is attached to an extendable handle. The actuator extends into the top portion of the handle and terminates in a lever that extends through a slot in the handle, which allows the actuator to be extended once the ball or fruit is retrieved. In some such embodiments, the lever is pivotally attached to the handle and to the actuator so that it may be extended by pulling a rope attached to the lever.

All the embodiments of the present invention result in a superior, light weight object retrieval device that activates with a bump, strike, or tap of the actuator.

Therefore it is an aspect of the present invention to provide an object retrieval apparatus that is operable from a distant location.

It is a further aspect of the invention to provide an object retrieval apparatus that is relatively lightweight.

It is a further aspect of the invention to provide an object retrieval apparatus that may be readily stored in a hunter's pack.

It is a further aspect of the invention to provide an object retrieval apparatus that is able to retrieve objects of various types and sizes.

It is a further aspect of the invention to provide an object retrieval apparatus that requires no hand strength or dexterity to operate.

It is a further aspect of the invention to provide an object retrieval apparatus that allows a user to retrieve objects when the user is located a substantial distance above the object.

It is a further aspect of the invention to retrieve objects in the water without the user getting wet.

It is a further aspect of the invention to provide an object retrieval apparatus that allows a user to retrieve objects without the user touching the objects with their hands.

It is a further aspect of the invention to provide an object retrieval apparatus that may operated without having to squeeze a handle.

It is a further aspect of the invention to provide an object retrieval apparatus that is compact in size.

It is a further aspect of the invention to provide an object retrieval apparatus that can be used by the elderly, small children and disabled persons.

These aspects of the invention are not to be exclusive and other features, aspects and advantages of the present invention will be readily apparent to those with ordinary skill in the art when read in conjunction with the following description, appended claims and accompanying drawings.

DETAILED DESCRIPTION OF THE DRAWINGS

Figure 1:
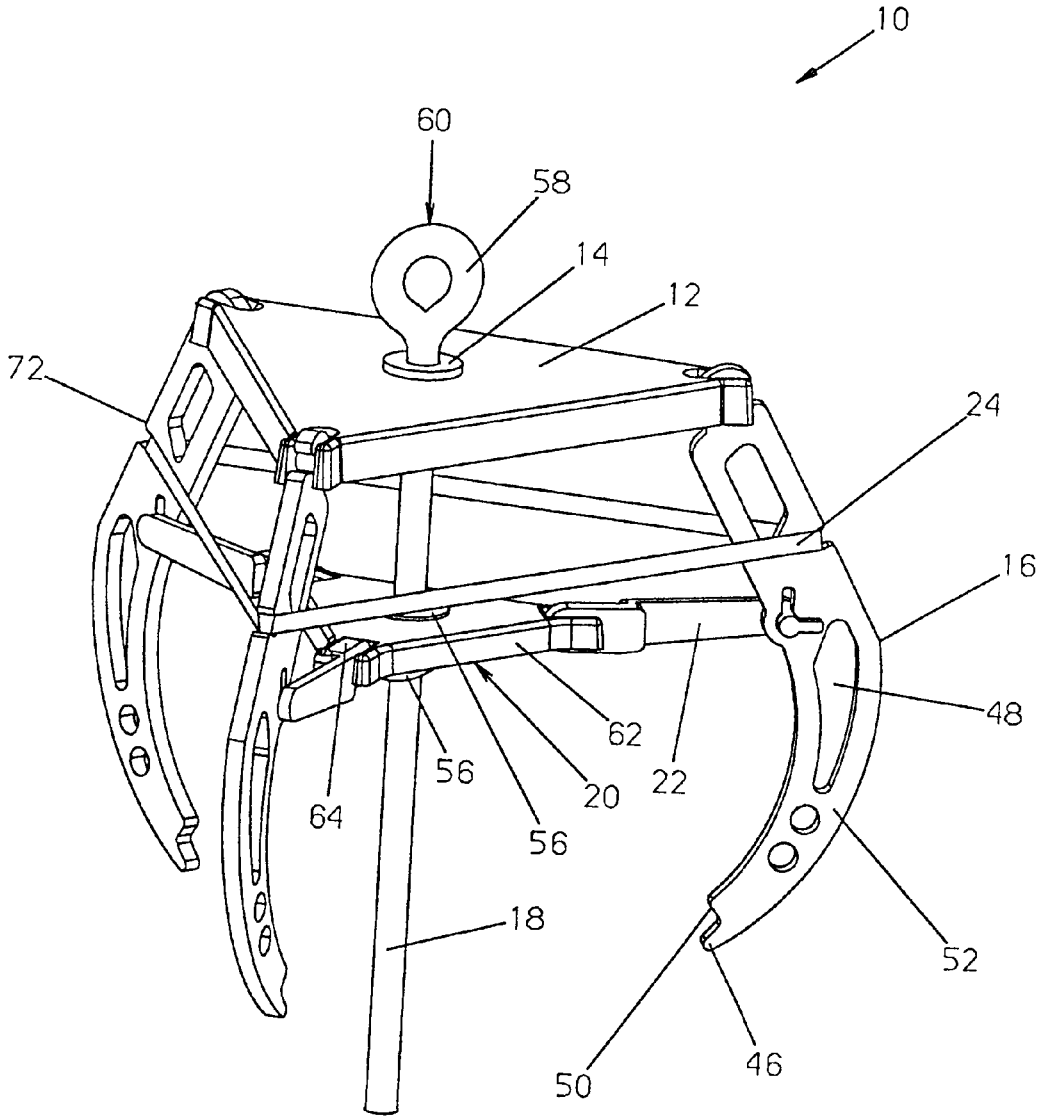
FIG. 1 is a front isometric view of the object retrieval apparatus of the present invention in an open position, ready to capture an object.

Referring first to FIG. 1 a front pictural view of the preferred embodiment of the present invention is shown. The object retrieval apparatus 10 of the present invention includes a base plate 12 having an opening 14 disposed therethrough proximate to its center. Three jaws 16 are pivotally attached to the base plate 12. An actuator 18 is movably disposed through the opening in the base plate 12 and is fixedly attached to a retention member 20. Three pivot arms 22 are pivotally attached to the retention member 20 and the jaws 16. Finally, a closing means 24, such as the elastic band shown in FIG. 1, is disposed about the jaws 16 and is utilized to close the jaws 16 once the actuator 18 is moved a predetermined distance towards the base plate 12.

As shown in FIG. 1, the preferred base plate 12 is substantially triangular and is manufactured of a substantially rigid material. In the preferred embodiment, a light weight material such as plastic or aluminum is utilized to make up the base plate. However, it is recognized that other substantially rigid metals, ceramics or the like could also be utilized to achieve similar results. Although a triangular shape is preferred, it is also recognized that the base plate 12 can be round, square, rectangular or other geometric configurations, provided that the base plate is substantially rigid and is dimensioned to accommodate the jaws 16.

Figure 2:
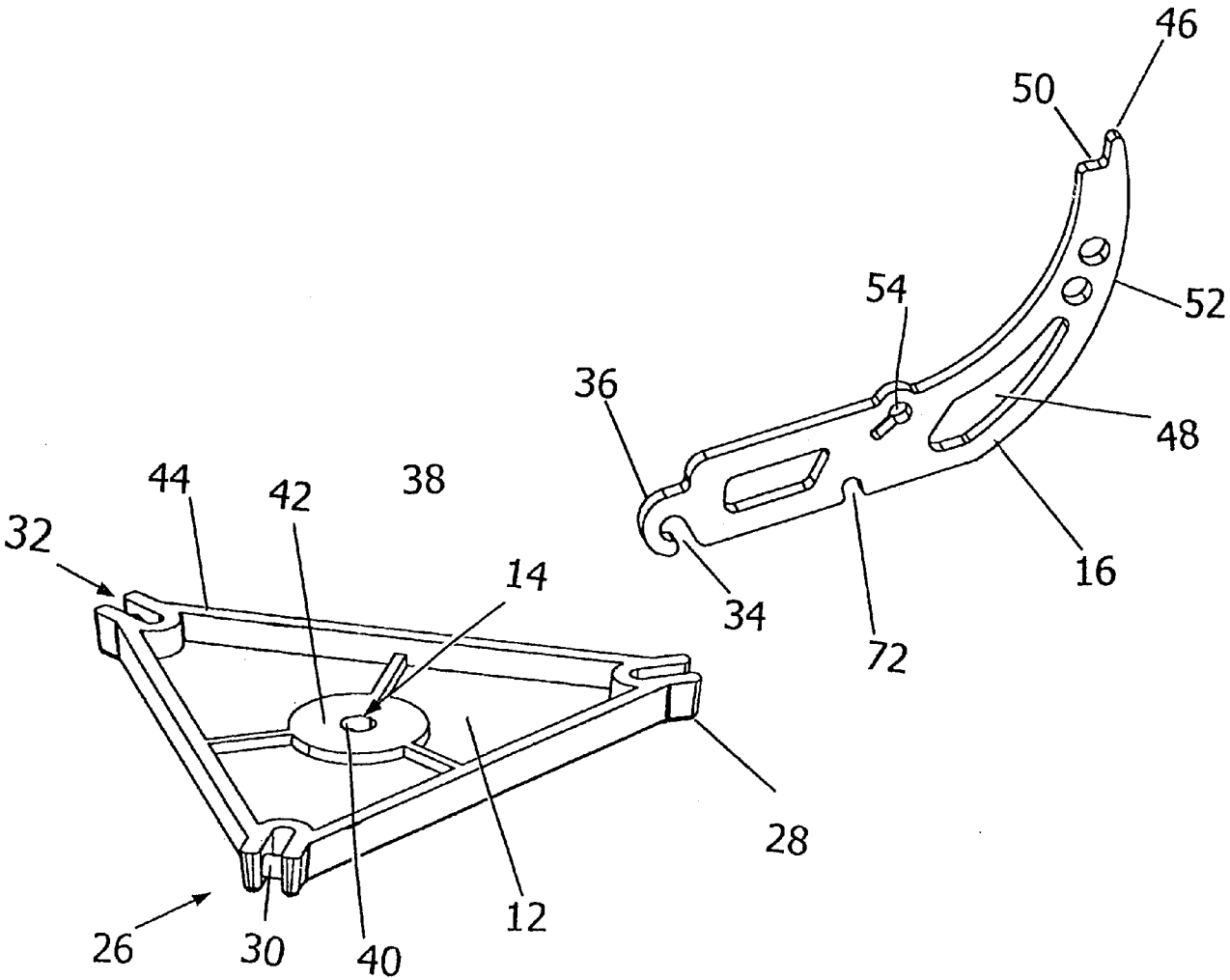
FIG. 2 is an isometric view of the base plate and jaw of the preferred apparatus of FIG. 1 in position for assembly.

As shown in FIGS. 1 and 2, the base plate 12 includes details 26 for pivotally mounting the jaws 16. In the preferred embodiment, these details 26 are disposed in each corner 28 of the triangular base plate 12 and consist of a pin 30 disposed within a clevis 32. The pin 30 and clevis 32 of these embodiments are dimensioned to accept the hook 34 located proximate to the base terminus 36 of the jaw 16 such the jaw 16 is retained within the clevis 32 and allowed to pivot about the pin 30.

The opening 14 of preferred base plate 12 is disposed proximate to the center of the base plate 12. However, in other embodiments, the opening 14 may be disposed in another location about the base plate 12, provided that the opening 14 is located substantially equidistant from each of the jaws 16.

As shown in FIG. 2, the preferred base plate 12 includes an area 38 surrounding the opening 14 that is thicker than the remainder of the base plate 12. This design is preferred as it provides the opening 14 with an increased bearing surface 40 that helps to maintain the actuator 18 in a substantially perpendicular position relative to the base plate 12 and provides added stiffness to the base plate 12, allowing the overall weight of the apparatus 10 to be reduced through the elimination of excess material. The preferred base plate 12 is further stiffened through the use of a plurality of stiffening members 42 extending from the thickened area 38 surrounding the opening 14 and a thickened edge 44 about the periphery of the base plate 12.

As shown in FIG. 2, the thickness of the edge 44 and the area 38 surrounding the opening 14 are substantially equal. However, in other embodiments, the edge 44 of the base plate 14 is substantially thicker than the area 38 surrounding the opening 14 such that a recess is formed to allow further travel of the retention member and, hence, the jaws 16. In still other embodiments, the thicker area 38, stiffening member 42 and edges 44 are eliminated and the base plate 12 is of substantially uniform thickness.

Referring again to FIGS. 1 and 2, the preferred jaw 16 is substantially "C" shaped and includes a base terminus 36 and a tip 46. The preferred jaw 16 is manufactured of the same substantially rigid material as the base plate 12 and includes a number of cut-outs 48 along its length. These cut-outs 48 allow the overall weight of the apparatus 10 be reduced, which is important in some embodiments. In other embodiments, the cut-outs 48 are utilized to reduce the effects of wind or flowing water on the position of the apparatus 10. In these embodiments, it is preferable to increase the overall weight of the apparatus 10 by attaching a weight (not shown) to the base plate 12, actuator 18, or other portion of the apparatus 10. Although the prefered jaws are "C" shaped and include cut-outs 48, it is recognized other embodiments the jaws 16 may be solid and may take a variety of a different shapes than the preferred "C" shape.

The preferred tips 46 of the jaws 16 are thin and terminate in a step 50, that demarcates the tip 46 from the body 52 of the jaw 16. However, tips having other shapes, or having additional structures attached thereto, are contemplated by the invention. For example, the tips 46 of the jaws 16 may be magnetized as an aid in retrieving metal objects, padded to allow delicate objects to be retrieved, or fitted with specialized attachments, such as rubber tips, caps for fitting over the tips, or other attachments that are specifically adapted to certain applications.

The preferred jaws 16 have slots 54 positioned to accept a mating detail (not shown) in the pivot arms 22. These slots 54 are positioned upon the jaw such that they are located along a plane formed by the retention member 20 when the jaws 16 of the apparatus 10 are in a fully open position. However, in other embodiments the jaws 16 may include other details, such as a pin and clevis arrangement, for pivotally attaching the pivot arms 22 to the jaw 16.

Referring again to FIG. 1, the actuator 18 passes through the opening in the base plate 12 and is fixedly attached to the retention member 20. In the embodiment of FIG. 1, the actuator 18 and retention member 20 are both made from the same substantially rigid plastic material as the base plate 12 and are fixedly attached via a pair of locking clips 56. However, in the preferred embodiment, the actuator 18 and retention member 20 are secured by locking tabs (not shown) that are formed into the actuator 18 and retention member 20. In other embodiments, such as those made from aluminum, the actuator 18 and retention member 20 may be attached via a set screw or cotter pin arrangement to achieve similar results. In still other embodiments, the actuator 18 and retention member 20 are glued, welded, soldered, or otherwise joined together via nonmechanical means.

As shown in FIG. 1, the preferred actuator 18 is substantially cylindrical in shape, which reduces friction and allows the actuator to fit through a standard drilled opening 14. However, it is recognized that other embodiments of the actuator 18 may have different shapes, provided that the openings 14 in the base plate 12 and retention member 20 are configured to accept the shape of the actuator 18. As will be described further herein, the actuator 18 may take a number of different forms and may, in some embodiments, include a magnetized tip in order to allow it to maintain contact with a metallic object during retrieval.

The preferred actuator 18 includes a ring 58 at a base end 60 proximate to the base plate 12. The ring 58 is dimensioned to accept a rope, string or chain (not shown), which allows the apparatus 10 to be lowered from a point above, a tree for example, to retrieve an object that has fallen below. In the embodiment of FIG. 1, the ring 58 provides a stop for limiting the travel of the actuator 18 when it is in an engaged position. However, in other embodiments, a separate stop, such as a set screw, locking clip, or the like, may be attached to the actuator 18 at a point between the base plate 12 and the end of the actuator 18 opposite the tip, in order to limit the travel of the jaws 16. In still other embodiments, the ring 58 is replaced by a knob or lever, which serves as the stop.

The preferred retention member 20 is triangular and manufactured of the same rigid plastic material as the base plate 12, jaws 16, and actuator 18. An opening is disposed through the center of the retention member 20 and is dimensioned to accept the actuator 18. Like the preferred base plate 12, the preferred retention member 20 has edges 62 of increased thickness about its periphery. In other embodiments, however, the retention member 20 is of substantially uniform thickness.

The retention member 20 is sized to fit within the space parallel to the surface of the base plate 12 that is bounded by the jaws 16 when the jaws 16 are closed. As noted above, the preferred embodiment of the retention member 20 is triangular in shape. However, other embodiments of the retention member 20 may have different geometric configurations, provided that these configurations allows the full movement of the pivot arms 22, jaws 16, and retention member 20.

The preferred retention member 20 includes pin and clevis details 64 at the each of the three points of the triangle. These details 64 are similar to the details 26 described above in reference to the base plate 12 and are dimensioned to pivotally attach the retention member 20 to the pivot arms 22. Like the base plate 12, however, other embodiments of the retention member 20 may utilize other art recognized means for pivotally connecting the retention member 20 and the pivot arms 22.

Figure 3:
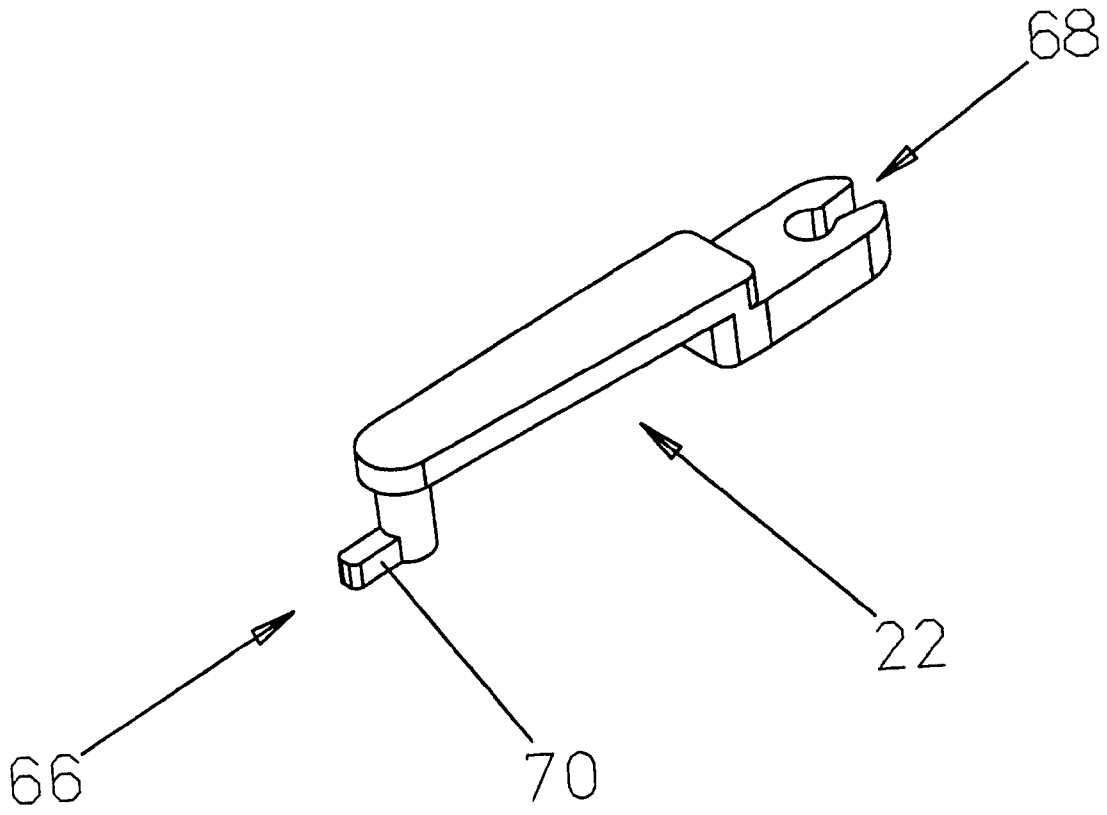
FIG. 3 is an isometric view of the pivot arm of the preferred apparatus of FIG. 1

Referring to FIGS. 1 and 3, the pivot arms 22 are preferably flat, rectangular, and manufactured of the same substantially rigid plastic material as the base plate 12, jaws 16, actuator 18, and retention member 20. However, it is recognized that pivot arms 22 of other shapes or materials may be utilized provided that they allow for pivotal connection to the jaws 16 and retention member 20 and for full movement therebetween.

The pivot arms 22 include mating details 66, 68 for pivotal attachment to the jaws 16 and retention member 20, respectively. In the preferred embodiment, the first mating detail 68 is configured to provide a rotational friction fit within a pin and clevis detail 64 in the retention member 20, while the second mating detail 66 includes a dog 70 that allows the pivot arm 22 to be pivotally attached to one of the jaws 16. As shown in FIGS. 2 and 3, the dog 70 on the pivot arm 22 is adapted for insertion through a slot 54 in a jaw 16 such that the pivot arm 22 is pivotally attached to the jaw 16. However, as noted above, other embodiments of the pivot arm 22 may utilize other mating details 66, 68 to achieve similar results.

Referring again to FIGS. 1 and 2, the preferred closing means 24 is an elastic band that is dimensioned to fit within a notch 72 in the jaw 16 and imparts an inward force on jaw 16. An elastic band is the preferred closing means 24 due to their low cost, ready availability, ease of removal, and the ability to vary tension strength through the use of different bands. However, other embodiments may use different closing means 24 to achieve similar results. For example, in some embodiments the closing means 24 may be a torsion spring that is disposed in similar notches 72 in the jaws 16 and act to close the jaws 16 in a manner similar to the preferred elastic band. In still other embodiments, a hydraulic or pneumatic cylinder may be attached to the actuator 18 such that the actuator is extended or retracted in a predetermined manner.

Figure 4:
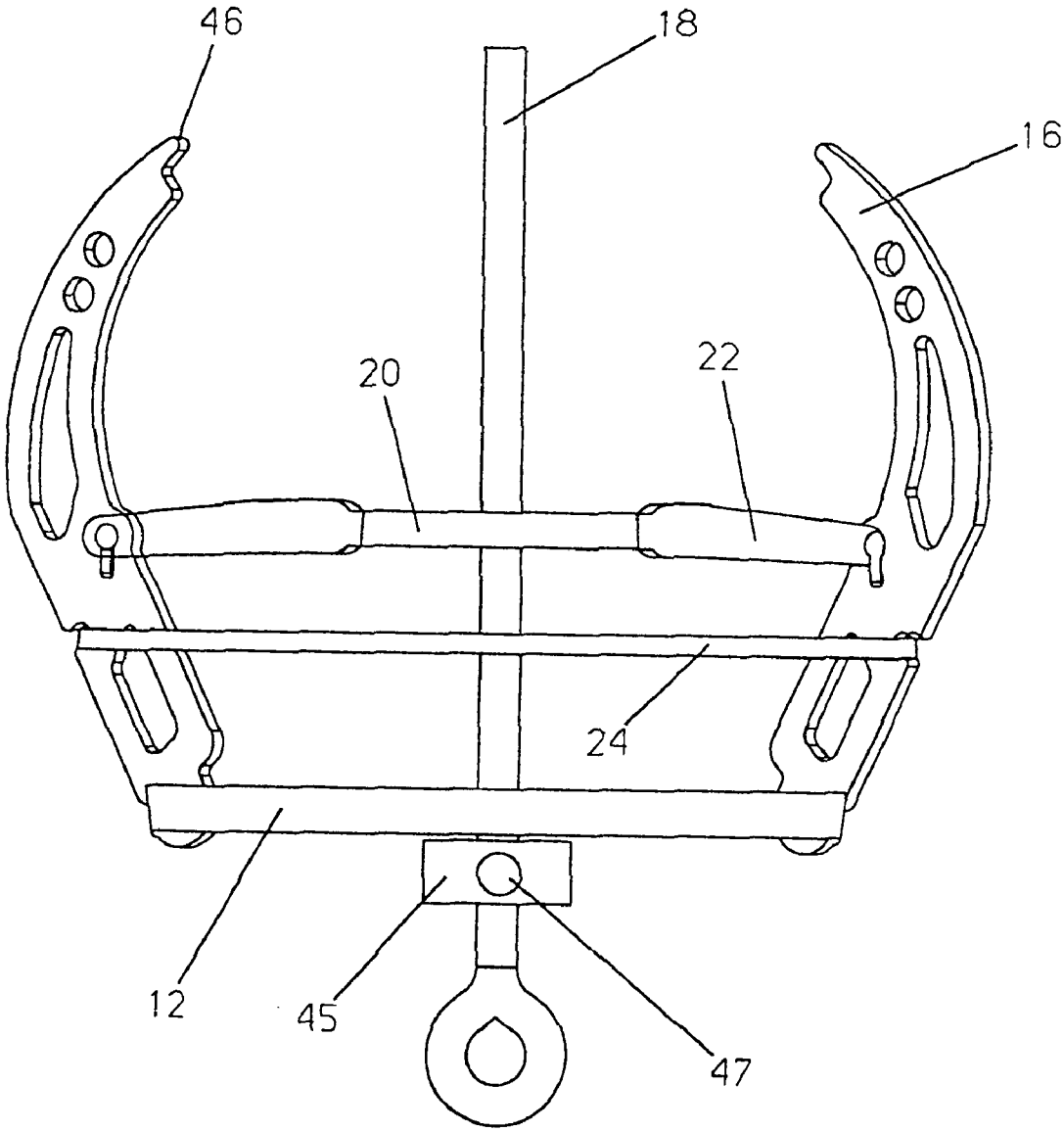
FIG. 4 is a front view of one embodiment of the present invention in an open position.
Figure 5:
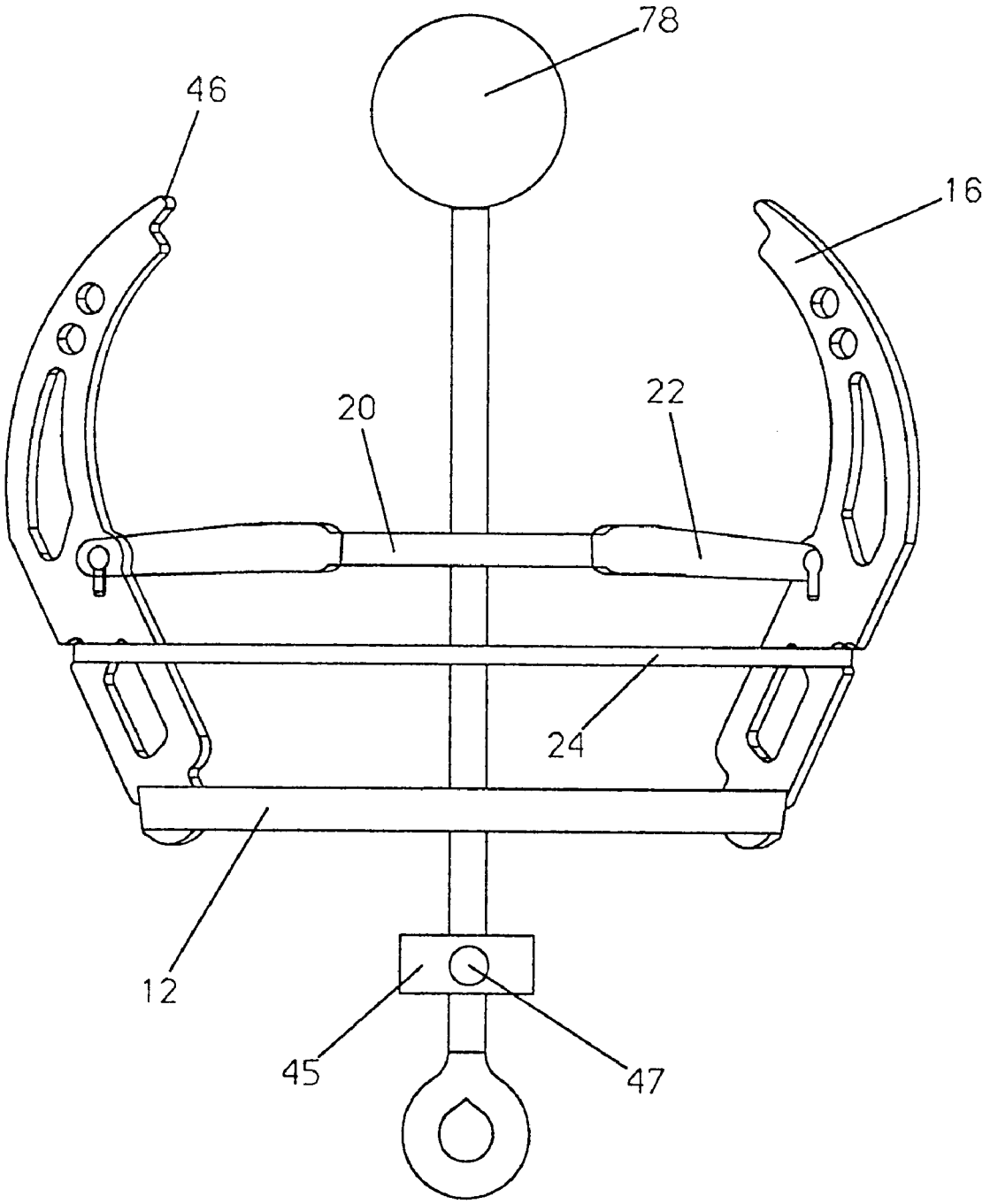
FIG. 5 is a front view of the embodiment of FIG. 4 with the actuator contacting an object and disposed at a trigger point.
Figure 6:
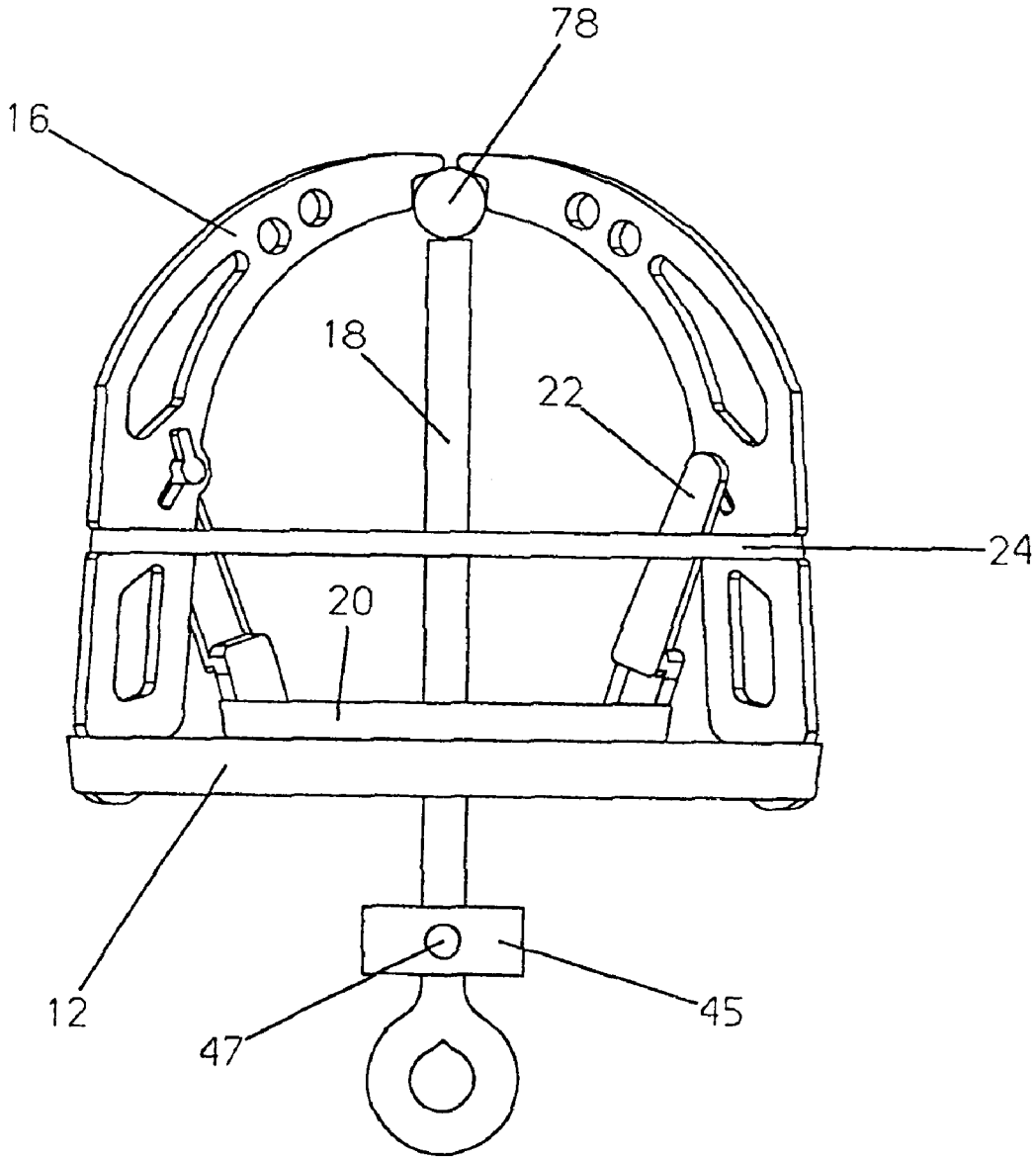
FIG. 6 is a front view of the embodiment of FIGS. 4 & 5 with jaws in a closed position around the object.

Referring now to FIGS. 4–6, the operation of the apparatus 10 will be described. FIGS. 4–6 show an embodiment of the invention utilizing two jaws 16. However, it is noted that the same principles will apply regardless of the number of jaws 16 utilized in a particular embodiment of the invention.

As shown in FIG. 4, the actuator 18 is initially positioned such that the jaws 16 are in open position and such that a stop 45, held in place via a set screw 47, rests against the base plate 12. In this initial, or open, position, the actuator 18 terminates at a point slightly above the tips 46 of the jaws 16, the retention member 20 and pivot arms 22 are in substantially parallel position, and the plane formed by the retention member 20 lies above a plane formed by the closing means 24, here an elastic band. In this arrangement, the inward force generated by the closing means 24 is fully opposed by a holding force exerted by the pivotal connection between the retention member 20 and the pivot arms 22.

As shown in FIG. 5, once the actuator 18 comes into contact with an object 78, or a surface proximate to the object, it is moved inward toward the base plate 12. This causes the retention member 20 to move toward the base plate 12 and the pivot arms 20 pivot such that they are placed at a slightly downward angle from the jaws 16 toward the retention member 20. When the actuator 18 has been moved to this point, referred to herein as the trigger point, the inward force generated by the closing means 24 is equal to the holding force exerted by the pivotal connection between the retention member 20 and the pivot arms 22. Once at the trigger point, any further movement of the actuator 18 toward the base plate 12 will cause the closing means 24 to engage and drive the jaws 16 inward.

As shown in FIG. 6, once past the trigger point, the inward force exerted by the closing means 24 causes the retention member 20 and actuator 18 to move toward the base plate 12. This simultaneously draws the jaws 16 inward such that their tips are proximate one another, and creates a space between the actuator 18 and the closed jaws 16 for accommodating the object 78 to be retrieved.

It is recognized that other embodiments may operate in a slightly different fashion. For example, in embodiments utilizing a hydraulic or pneumatic closing means, the location of the trigger point at the balancing of spring force is not feasible. Accordingly, in these embodiments, an electrical or pneumatic switch is installed to detect movement of the actuator 18 past the trigger point and cause the hydraulic or pneumatic closing means 24 to retract when the actuator 18 passes that point.

Figure 7:
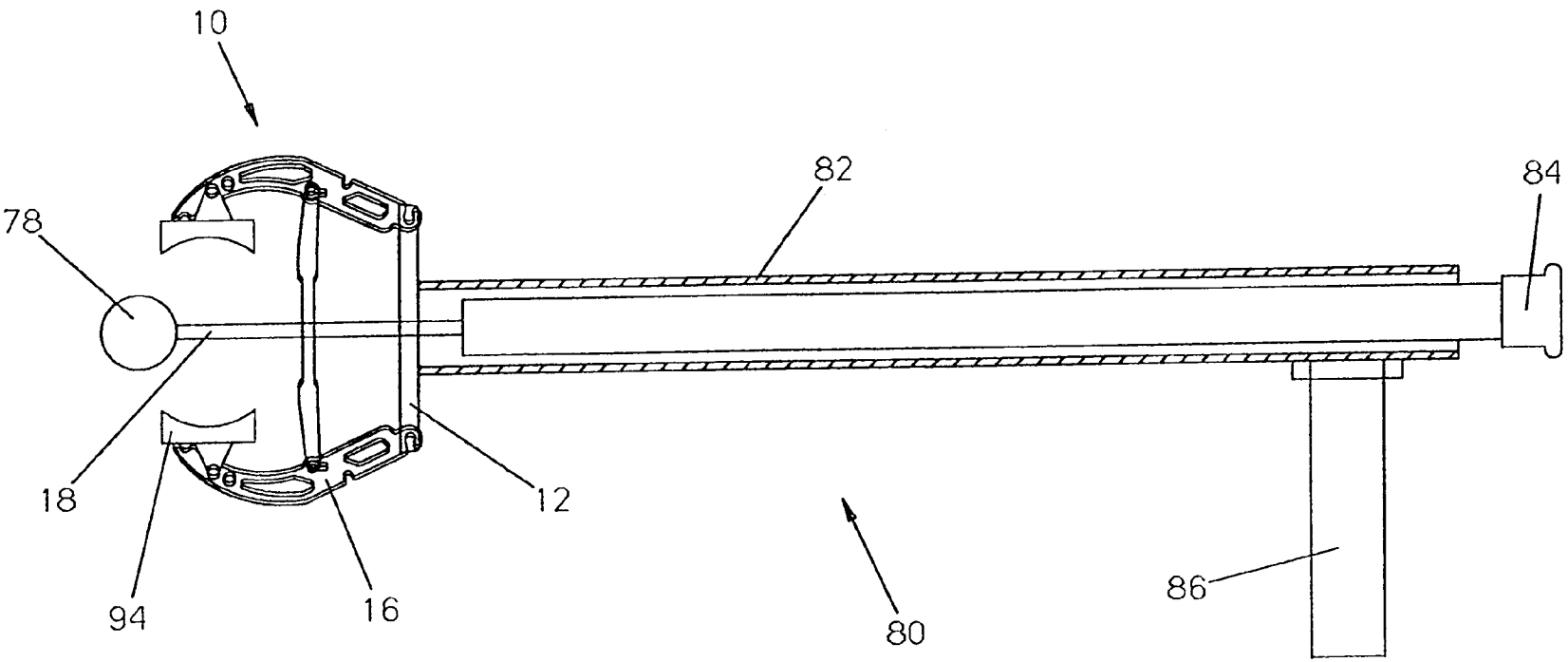
FIG. 7 is a cut away side view of an alternative embodiment in which the apparatus of the present invention is utilized as part of a reacher.

Referring now to FIG. 7, an alternative embodiment of the present invention is shown in which the apparatus 10 is utilized as part of a reacher 80. Here the base plate 12 is fixedly attached to a hollow tube 82 and the actuator 18 is extended such that it passes through the tube 82 and terminates at a loading knob 84. The loading knob 84 is preferably cushioned to allow the apparatus 10 to be positioned in an open position with a tap or a push against a solid surface, or against the operator. The loading knob 84 also serves as a stop for the travel of the actuator 18. In some embodiments, a handle 86 is provided. In still other embodiments, both a handle 86 and a wrist cuff (not shown) are provided in order to allow a user having little or no manual dexterity to position the apparatus 10 relative to the desired object such that it may be retrieved. When used in this configuration, the apparatus 10 of the present invention provides an effective reacher that does not require significant hand strength or dexterity.

In the embodiment of FIG. 7, the jaws 16 are substantially straight and are fitted with a specialized set of attachments 94 for grasping cans of food, or other cylindrical objects 78. As noted above, however, it is recognized that other attachment 94, or jaws 16 having different shapes, may also be utilized to achieve similar results.

Figure 8:
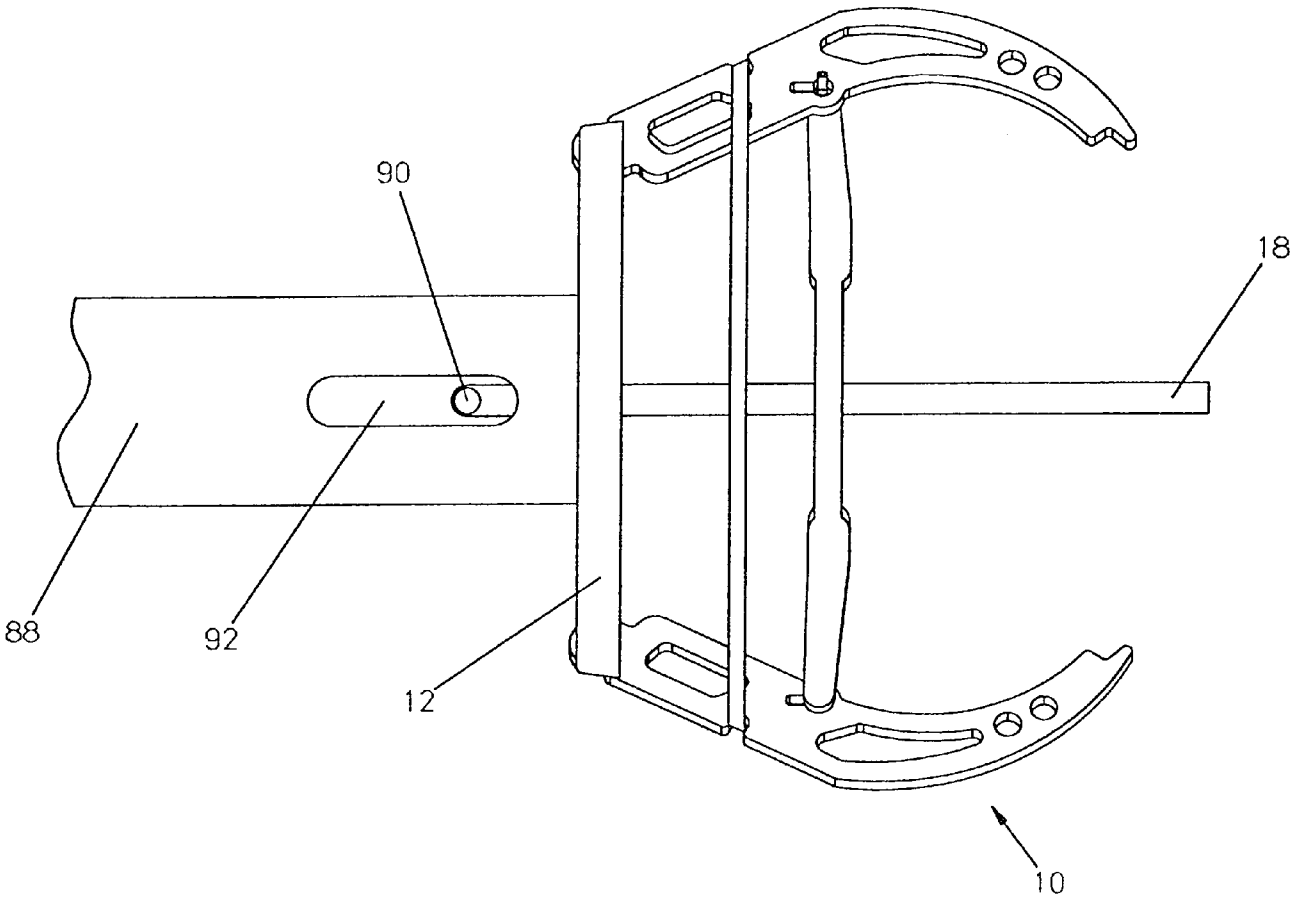
FIG. 8 is a cut away side view of another alternative embodiment in which the apparatus of the present invention is utilized as part of a golf ball retriever or fruit harvester.

Referring now to FIG. 8, still another alternative embodiment is shown in which the apparatus 10 is utilized as part of a golf ball retriever or fruit harvester. In this embodiment, the base plate 12 of the apparatus 10 is fixedly attached to one end of an extendable pole 88 (sectioned for clarity). Because of the variability in length of the handle 88, in these embodiments, the actuator 18 extends into the top portion of the handle 88 and terminates in a lever 90 that extends through a slot 92 in the handle 88. In this manner, the lever 90 may be engaged to extend the actuator to be extended once the ball or fruit is retrieved. The lever 90 in these embodiments also serves as a stop to limit the travel of the actuator 18. In some such embodiments, the lever 90 is pivotally attached to the handle 80 and to the actuator 18 so that it may be extended by pulling a rope (not shown) that is attached to the lever 90.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. An object retrieval apparatus for retrieving an object comprising:

a base plate, said base plate having an opening disposed therethrough at a predetermined location;

at least two jaws pivotally attached to said base plate;

an actuator movably disposed through said opening in said base plate, a retention member fixedly attached to said actuator;

at least two pivot arms pivotally attached to said retention member and said jaws; and a closing means for closing said jaws;

wherein said actuator is positioned such that said jaws are in open position, said actuator is caused to contact the object to be retrieved such that said retention member and said pivot arms are moved towards said base plate, and wherein said closing means is engaged by the travel of said actuator past a trigger point and causes said jaws to be driven inward to capture said object.

2. The apparatus as claimed in claim 1 wherein said base plate is substantially triangular in shape and further comprises pin and clevis details at each point of said triangle for pivotally attaching said jaws to said base plate.

3. The apparatus as claimed in claim 1 wherein said base plate further comprises an area surrounding said opening in said base plate that is of a greater thickness than another portion of a surface of said base plate.

4. The apparatus as claimed in claim 1 wherein said base plate further comprises at least one stiffening member.

5. The apparatus as claimed in claim 1 wherein said jaws are substantially C shaped.

6. The apparatus as claimed in claim 1 comprising at least three jaws.

7. The apparatus as claimed in claim 1 wherein said closing means is an elastic band.

8. The apparatus as claimed in claim 7 wherein each of said jaws further comprises a notch for accepting said elastic band.

9. The apparatus as claimed in claim 1 wherein said jaws comprise cut-outs.

10. The apparatus as claimed in claim 1 wherein said retention member is substantially triangular in shape and comprises pin and clevis details at each point of said triangle for pivotally attaching said pivot arms to said retention member.

11. The apparatus as claimed in claim 1 wherein said retention member is fixedly attached to said actuator via a pair of clips.

12. The apparatus as claimed in claim 1 wherein said actuator terminates in a ring.

13. The apparatus as claimed in claim 1 further comprising a hollow tube, said hollow tube being fixedly attached to said base plate and having an internal opening sized to allow said actuator to pass therethrough.

14. The apparatus as claimed in claim 13 wherein said actuator is dimensioned to pass through the length of said tube and to extend from an opposite end of said tube.

15. The apparatus as claimed in claim 13 further comprising a handle attached to said opposite end of said tube.

16. The apparatus as claimed in claim 1 further comprising an extendable handle, said extendable handle being fixedly attached to said base plate.

17. The apparatus as claimed in claim 16 wherein said extendable handle comprises a hollow end and a slot, and wherein said actuator is dimensioned to extend into said hollow end of said handle and further comprises a lever dimensioned to extend through said slot.

* * * * *